US011586234B2

(12) United States Patent
Sung et al.

(10) Patent No.: US 11,586,234 B2
(45) Date of Patent: Feb. 21, 2023

(54) POWER SUPPLY DEVICE

(71) Applicant: PEGATRON CORPORATION, Taipei (TW)

(72) Inventors: Hsiao-Wei Sung, Taipei (TW); Chun-Wei Ko, Taipei (TW); Yu-Kai Shen, Taipei (TW); Chih-Wei Huang, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 57 days.

(21) Appl. No.: 17/313,246

(22) Filed: May 6, 2021

(65) Prior Publication Data

US 2021/0397208 A1 Dec. 23, 2021

(30) Foreign Application Priority Data

Jun. 17, 2020 (TW) ..... 109120300

(51) Int. Cl.
*G05F 1/62* (2006.01)
*G05F 1/575* (2006.01)

(52) U.S. Cl.
CPC ..... *G05F 1/575* (2013.01)

(58) Field of Classification Search
CPC ..... G05F 1/62
See application file for complete search history.

(56) References Cited

U.S. PATENT DOCUMENTS 6,150,798 A * 11/2000 Ferry ..... H02M 3/158 323/288
7,602,167 B2 * 10/2009 Trafton ..... G05F 1/56 323/284
7,629,712 B2 * 12/2009 Nakashima ..... H02J 1/08 307/31
7,802,122 B2 * 9/2010 Park ..... G06F 1/26 713/340
7,928,705 B2 * 4/2011 Hooijschuur ..... H02M 3/07 323/272

(Continued)

FOREIGN PATENT DOCUMENTS

CN 110445362 A 11/2019
TW 201005461 A 2/2010

(Continued)

*Primary Examiner* — Thomas J. Hiltunen
(74) *Attorney, Agent, or Firm* — Li & Cai Intellectual Property (USA) Office

(57) ABSTRACT

The application discloses a power supply circuit and a power supply device. A drain of a first N-type metal-oxide-semiconductor field-effect transistor (MOSFET) receives a first input voltage. A filter is coupled to a source of the first N-type MOSFET and is configured to output an output voltage. A non-inverting input terminal of an operational amplifier is coupled to a ground terminal through a first capacitor. A control circuit is coupled to an inverting input terminal of the operational amplifier. One terminal of a switch is coupled to a gate of the first N-type MOSFET, and the other terminal is switchably coupled to the control circuit or an output terminal of the operational amplifier, so that the gate of the first N-type MOSFET is switched to be coupled to the control circuit or the output terminal of the operational amplifier.

5 Claims, 2 Drawing Sheets

(56) References Cited

U.S. PATENT DOCUMENTS

| | | | | |
|---|---|---|---|---|
| 8,044,708 | B2 * | 10/2011 | Kume | G05F 1/56 327/143 |
| 8,164,309 | B2 | 4/2012 | Li | |
| 8,803,492 | B2 * | 8/2014 | Liu | H02M 3/1588 323/266 |
| 9,577,523 | B2 * | 2/2017 | Cowley | H02M 3/158 |
| 10,038,377 | B2 | 7/2018 | Ramachandran et al. | |
| 10,305,308 | B2 * | 5/2019 | Tsai | H02J 7/0068 |
| 10,666,141 | B2 * | 5/2020 | Wang | H02M 3/158 |
| 2006/0158165 | A1 * | 7/2006 | Inn | H02M 3/1588 323/280 |
| 2009/0295344 | A1 * | 12/2009 | Qu | G05F 1/56 323/265 |
| 2015/0042295 | A1 * | 2/2015 | Cowley | H02M 3/158 323/269 |
| 2017/0310214 | A1 | 10/2017 | Kawano et al. | |
| 2018/0048232 | A1 | 2/2018 | Adell et al. | |
| 2019/0214906 | A1 | 7/2019 | Mahmoudi et al. | |

FOREIGN PATENT DOCUMENTS

| | | | |
|---|---|---|---|
| TW | 1378628 | B1 | 12/2012 |
| TW | M458031 | U1 | 7/2013 |
| WO | WO 2018030230 | A1 | 2/2018 |

* cited by examiner

POWER SUPPLY DEVICE

CROSS-REFERENCE TO RELATED APPLICATION

This application claims the priority benefit of Taiwan application serial no. 109120300, filed on Jun. 17, 2020. The entirety of the above-mentioned patent application is hereby incorporated by reference herein and made a part of this specification.

BACKGROUND

Technical Field

The application relates to a power supply circuit and a power supply device, and in particular, to a power supply circuit and a power supply device that can be integrated into a circuit line having a buck converter and a low-dropout regulator.

Related Art

Currently, most electronic devices with batteries as power inputs, such as mobile phones or portable media players, usually use a buck converter to provide an output voltage lower than an input voltage to assemblies of the electronic devices. However, because the buck converter suffers from a relatively poor efficiency and a relatively high power consumption at a light load, the buck converter and the low-dropout regulator have been integrated into the same power supply circuit such as a power management IC in the prior art. In this way, when an output is a light load, the power supply circuit may be switched to a low-dropout regulator mode to improve the efficiency at the light load. However, costs are increased instead. Therefore, how to design a power supply circuit and a power supply device that can not only integrate circuit lines of the buck converter and the low-dropout regulator but also effectively reduce the costs has become an important topic in the field.

SUMMARY

In view of this, embodiments of the application provide a power supply circuit, including a first N-type metal-oxide-semiconductor field-effect transistor (MOSFET), a filter, an operational amplifier, a control circuit, and a first switch. A drain of the first N-type MOSFET receives a first input voltage. The filter is coupled to a source of the first N-type MOSFET and is configured to output an output voltage. A non-inverting input terminal of the operational amplifier is coupled to a ground terminal through a first capacitor. The control circuit is coupled to an inverting input terminal of the operational amplifier. One terminal of the first switch is coupled to a gate of the first N-type MOSFET, and the other terminal is switchably coupled to the control circuit or an output terminal of the operational amplifier, so that the gate of the first N-type MOSFET is switched to be coupled to the control circuit or the output terminal of the operational amplifier.

Further, when an output of the power supply circuit is not a light load, the first switch is controlled by a first switch signal, so that the gate of the first N-type MOSFET is switched to be coupled to the control circuit, and the control circuit is configured to control the first N-type MOSFET to be turned on or turned off according to a feedback voltage corresponding to the output voltage, so that the first N-type MOSFET is used as a high-side MOSFET in a buck converter.

Further, when the output of the power supply circuit is the light load, the first switch is controlled by the first switch signal, so that the gate of the first N-type MOSFET is switched to be coupled to the output terminal of the operational amplifier, and the control circuit is configured to provide the feedback voltage to the inverting input terminal of the operational amplifier, so that the first N-type MOSFET is used as a power transistor in a low-dropout regulator.

Further, the power supply circuit further includes an input capacitor and a second N-type MOSFET. A first terminal of the input capacitor is coupled to the drain of the first N-type MOSFET, a second terminal of the input capacitor is coupled to the ground terminal, and the input capacitor is configured to provide the first input voltage. A drain of the second N-type MOSFET is coupled to the source of the first N-type MOSFET and the filter, a source of the second N-type MOSFET is coupled to the ground terminal, and a gate of the second N-type MOSFET is coupled to the control circuit. When the output of the power supply circuit is not the light load, the control circuit is also configured to control the second N-type MOSFET to be turned on or turned off according to the feedback voltage, so that the second N-type MOSFET is used as a low-side MOSFET in the buck converter.

Further, the filter includes an inductor and an output capacitor. A first terminal of the inductor is coupled to the source of the first N-type MOSFET and the drain of the second N-type MOSFET. A first terminal of the output capacitor is coupled to a second terminal of the inductor, and a second terminal of the output capacitor is coupled to the ground terminal, so that the filter generates the output voltage at the first terminal of the output capacitor and the second terminal of the inductor.

Further, the power supply circuit further includes a feedback circuit coupled between the second terminal of the inductor and the control circuit and configured to generate and provide the corresponding feedback voltage to the control circuit according to the output voltage.

In addition, an embodiment of the application further provides a power supply device including a first-order buck converter, a second-order buck assembly, a timing switch circuit, and a second switch. The second-order buck assembly may be the above power supply circuit. A first terminal of the timing switch circuit and an output terminal of the first-order buck converter are jointly coupled to the drain of the first N-type MOSFET of the above power supply circuit through a node. One terminal of the second switch is coupled to an input terminal of the power supply device, and the other terminal is switchably coupled to an input terminal of the first-order buck converter or a second terminal of the timing switch circuit, so that the input terminal of the power supply device is switched to be coupled to the input terminal of the first-order buck converter or the second terminal of the timing switch circuit, and the input terminal of the power supply device may receive a second input voltage higher than the first input voltage.

Further, when an output of the power supply device is not a light load, the second switch is controlled by a second switch signal, so that the input terminal of the power supply device is switched to be coupled to the input terminal of the first-order buck converter, the first switch is controlled by a first switch signal, so that the gate of the first N-type MOSFET is switched to be coupled to the control circuit, and the control circuit is configured to control the first N-type MOSFET to be turned on or turned off according to a feedback voltage corresponding to the output voltage, so that the first N-type MOSFET is used as a high-side MOSFET in a second-order buck converter.

Further, when the output of the power supply device is the light load, the second switch is controlled by the second switch signal, so that the input terminal of the power supply device is switched to be coupled to the second terminal of the timing switch circuit, the first switch is controlled by the first switch signal, so that the gate of the first N-type MOSFET is switched to be coupled to the output terminal of the operational amplifier, and the control circuit is configured to provide the feedback voltage to the inverting input terminal of the operational amplifier, so that the first N-type MOSFET is used as a power transistor in a low-dropout regulator.

Further, the timing switch circuit includes a timer and a third switch. The timer is configured to provide a third switch signal. One terminal of the third switch is coupled to the first terminal of the timing switch circuit, and the other terminal is switchably coupled to the second terminal of the timing switch circuit, so that the first terminal and the second terminal of the timing switch circuit are switched to be connected or disconnected.

Further, the power supply device further includes a charging capacitor. A first terminal of the charging capacitor is coupled to the above node, and a second terminal of the charging capacitor is coupled to the ground terminal. When the output of the power supply device is the light load, the third switch is controlled by the third switch signal so that the first terminal and the second terminal of the timing switch circuit are switched to be connected or disconnected to charge the charging capacitor.

Based on the above, the embodiments of the application provide a power supply circuit and a power supply device. The power supply circuit may switch the first N-type MOSFET in the buck converter to serve as the power transistor in the low-dropout regulator by using the operational amplifier, the control circuit, and the first switch. Therefore, according to the application, not only the circuit lines of the buck converter and the low-dropout regulator can be integrated, but also costs can be effectively reduced. In addition, when the input voltage is relatively high and the output of the power supply device is the light load, the power supply device may switch, through the second switch, to charge the charging capacitor through the timing switch circuit, to supply power to the second-order buck assembly that provides a function of the low-dropout regulator, thereby resolving the problem of relatively great power consumption caused by the first-order buck converter when the output of the power supply device is the light load.

For further understanding of features and technical content of the application, refer to the following detailed description and drawings related to the application. However, the provided drawings are merely for reference and description, and are not intended to limit the application.

DETAILED DESCRIPTION OF THE EMBODIMENTS

Figure 1:
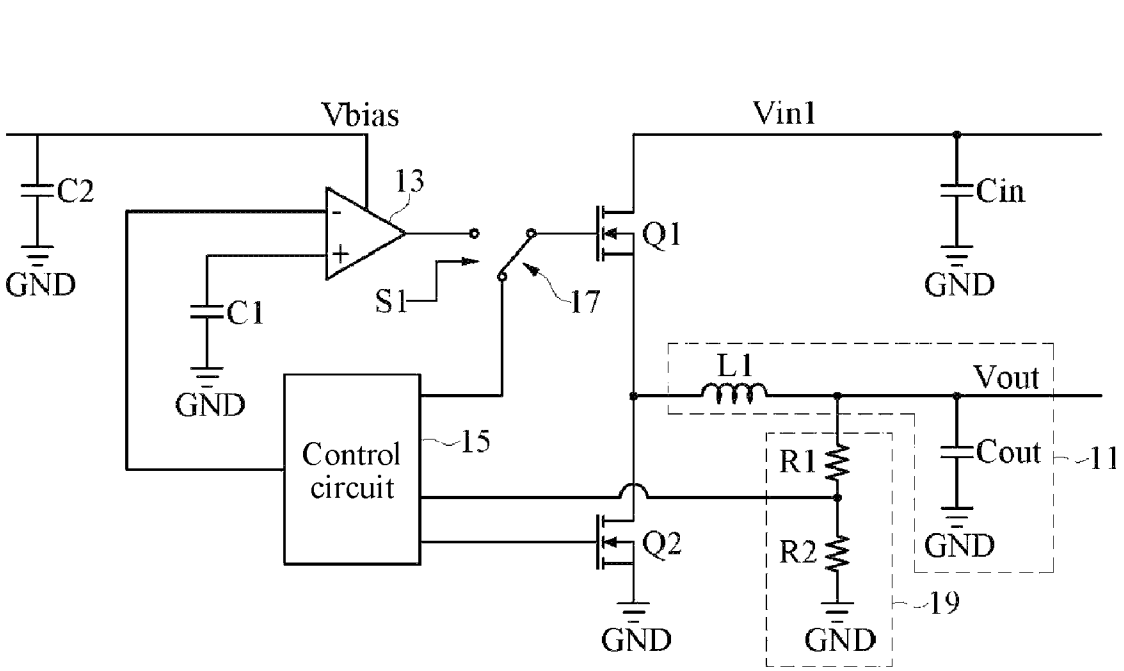
FIG. 1 is a schematic diagram of a power supply circuit according to an embodiment of the application.

Referring to FIG. 1, FIG. 1 is a schematic diagram of a power supply circuit according to an embodiment of the application. It should be noted that the power supply circuit 1 of FIG. 1 may be used in an electronic device that uses a battery as a power input, but the application does not limit the power supply circuit 1 of FIG. 1 to be used only in such electronic devices. As shown in FIG. 1, the power supply circuit 1 may include a first N-type MOSFET Q1, a filter 11, an operational amplifier 13, a control circuit 15, and a first switch 17. A drain of the first N-type MOSFET Q1 receives a first input voltage Vin1.

The filter 11 is coupled to a source of the first N-type MOSFET Q1 and is configured to output an output voltage Vout. A non-inverting input terminal of the operational amplifier 13 is coupled to a ground terminal GND through a first capacitor C1. The control circuit 15 is coupled to an inverting input terminal of the operational amplifier 13. One terminal of the first switch 17 is coupled to a gate of the first N-type MOSFET Q1, and the other terminal is switchably coupled to the control circuit 15 or an output terminal of the operational amplifier 13, so that the gate of the first N-type MOSFET Q1 is switched to be coupled to the control circuit 15 or the output terminal of the operational amplifier 13.

In addition, the power supply circuit 1 may further include an input capacitor Cin and a second N-type MOSFET Q2. A first terminal of the input capacitor Cin is coupled to the drain of the first N-type MOSFET Q1, a second terminal of the input capacitor Cin is coupled to the ground terminal GND, and the input capacitor Cin is configured to provide the first input voltage Vin1. A drain of the second N-type MOSFET Q2 is coupled to the source of the first N-type MOSFET Q1 and the filter 11, a source of the second N-type MOSFET Q2 is coupled to the ground terminal GND, and a gate of the second N-type MOSFET Q2 is coupled to the control circuit 15.

In this embodiment, the filter 11 may include an inductor L1 and an output capacitor Cout. A first terminal of the inductor L1 is coupled to the source of the first N-type MOSFET Q1 and the drain of the second N-type MOSFET Q2. A first terminal of the output capacitor Cout is coupled to a second terminal of the inductor L1, and a second terminal of the output capacitor Cout is coupled to the ground terminal GND, so that the filter 11 can generate the output voltage Vout at the first terminal of the output capacitor Cout and the second terminal of the inductor L1.

Correspondingly, the power supply circuit 1 may further include a feedback circuit 19 coupled between the second terminal of the inductor L1 and the control circuit 15 and configured to generate and provide a corresponding feedback voltage (not shown in FIG. 1) to the control circuit 15 according to the output voltage Vout. In practice, the feedback circuit 19 may be, for example, a voltage divider, and includes a first resistor R1 and a second resistor R2 connected in series. In other words, a first terminal of the first resistor R1 is coupled to the first terminal of the output capacitor Cout and the second terminal of the inductor L1, a second terminal of the first resistor R1 is coupled to a first terminal of the second resistor R2, and a second terminal of the second resistor R2 is coupled to the ground terminal GND.

In addition, the control circuit 15 is coupled to the second terminal of the first resistor R1 and the first terminal of the second resistor R2 to obtain the feedback voltage corresponding to the output voltage Vout. The application does not limit a specific implementation of the control circuit 15. In summary, when the output of the power supply circuit 1 is not the light load, the first switch 17 is controlled by the first switch signal S1, so that the gate of the first N-type MOSFET Q1 is switched to be coupled to the control circuit 15. After the gate of the first N-type MOSFET Q1 is switched to be coupled to the control circuit 15, power is supplied from the input capacitor Cin to the output capacitor Cout under the effect of the first N-type MOSFET Q1 and the second N-type MOSFET Q2. Therefore, when the output of the power supply circuit 1 is not the light load, the control circuit 15 is configured to control the first N-type MOSFET Q1 to be turned on or turned off according to the feedback voltage corresponding to the output voltage Vout, so that the first N-type MOSFET Q1 is used as a high-side MOSFET in the buck converter.

Similarly, when the output of the power supply circuit 1 is not the light load, the control circuit 15 is also configured to control the second N-type MOSFET Q2 according to the feedback voltage corresponding to the output voltage Vout, so that the second N-type MOSFET Q2 is used as a low-side MOSFET in the buck converter. In other words, when the output of the power supply circuit 1 is not the light load, the power supply circuit 1 switches the gate of the first N-type MOSFET Q1 to be coupled to the control circuit 15 by using the first switch 17, and the control circuit 15 is configured to control the first N-type MOSFET Q1 and the second N-type MOSFET Q2 to be turned on or turned off according to the feedback voltage corresponding to the output voltage Vout, so that the power supply circuit 1 can establish a circuit line of the buck converter through the input capacitor Cin, the first N-type MOSFET Q1, the second N-type MOSFET Q2, the filter 11, the feedback circuit 19, the control circuit 15, and the first switch 17 to provide a function of the buck converter.

It should be noted that a case that the output of the power supply circuit 1 is not the light load includes a case that the output of the power supply circuit 1 is no load, a half load, a heavy load, a full load, and the like. The application does not limit an actual situation that the output of the power supply circuit 1 is not the light load. Moreover, the first switch signal S1 in this embodiment may be provided by, for example, an embedded controller in an electronic device, but the application does not limit a specific implementation of the first switch signal S1 provided by the electronic device either. Those of ordinary skill in the art should be able to perform designing according to actual needs or application. In addition, when the output of the power supply circuit 1 is the light load, the first switch 17 is controlled by the first switch signal S1, so that the gate of the first N-type MOSFET Q1 is switched to be coupled to the output terminal of the operational amplifier 13. After the gate of the first N-type MOSFET Q1 is switched to be coupled to the output terminal of the operational amplifier 13, power is directly supplied from the input capacitor Cin to the output capacitor Cout through the first N-type MOSFET Q1. Therefore, when the output of the power supply circuit 1 is the light load, the control circuit 15 is configured to provide the feedback voltage to the inverting input terminal of the operational amplifier 13. In addition, a main function of the operational amplifier 13 is to stabilize the output voltage Vout, so that the first N-type MOSFET Q1 is used as the power transistor in the low-dropout regulator.

For example, when the output voltage Vout changes, a voltage difference between a feedback voltage generated by the feedback circuit 19 and a reference voltage of the first capacitor C1 is to be amplified by the operational amplifier 13 and outputted to the gate of the first N-type MOSFET Q1 through the output terminal of the operational amplifier 13, thereby adjusting input/output characteristics of the first N-type MOSFET Q1 to adjust the output voltage Vout. In other words, when the output of the power supply circuit 1 is the light load, the power supply circuit 1 switches the gate of the first N-type MOSFET Q1 to be coupled to the output terminal of the operational amplifier 13 by using the first switch 17, and the control circuit 15 is configured to provide the feedback voltage to the inverting input terminal of the operational amplifier 13, so that the power supply circuit 1 can establish a circuit line of the low-dropout regulator through the input capacitor Cin, the first N-type MOSFET Q1, the filter 11, the feedback circuit 19, the control circuit 15, the operational amplifier 13, and the first switch 17, to provide a function of the low-dropout regulator, thereby improving efficiency at the light load and correspondingly reducing power consumption.

In addition, during adjustment of the output voltage Vout by using the first N-type MOSFET Q1, the gate of the first N-type MOSFET Q1 requires a driving voltage (not shown in FIG. 1) higher than the output voltage Vout. Therefore, a positive power terminal of the operational amplifier 13 may provide a driving voltage for the gate of the first N-type MOSFET Q1 by receiving a bias voltage Vbias, that is, the bias voltage Vbias is greater than the output voltage Vout. In this way, the power supply circuit 1 may use a relatively low first input voltage Vin1, for example, 1 volt (V). It should be noted that the bias voltage Vbias may be provided by, for example, an internal capacitor or an external input. As shown in FIG. 1, the power supply circuit 1 may further include a second capacitor C2 coupled between the positive power terminal of the operational amplifier 13 and the ground terminal GND, to provide a bias voltage Vbias, but the application is not limited thereto.

In summary, in the application, the high-side MOSFET in the buck converter, that is, the first N-type MOSFET Q1 can be switched to serve as the power transistor in the low-dropout regulator through the operational amplifier 13, the control circuit 15, and the first switch 17. Therefore, according to the application, not only the circuit lines of the buck converter and the low-dropout regulator can be integrated, but also costs can be effectively reduced. It is worth mentioning that, in this embodiment, a condition for selectively switching the gate of the first N-type MOSFET Q1 to be coupled to the control circuit 15 or the operational amplifier 13 through the first switch 17 may also be modified and changed based on different viewpoints and applications without departing from the conception of the application. For example, under specific requirements, in the application, the gate of the first N-type MOSFET Q1 may also be allowed to be switched to be coupled to the output terminal of the operational amplifier 13 to establish the line of the low-dropout regulator, to achieve low noise, a low current, or a relatively small difference between an input voltage and an output voltage.

Figure 2:
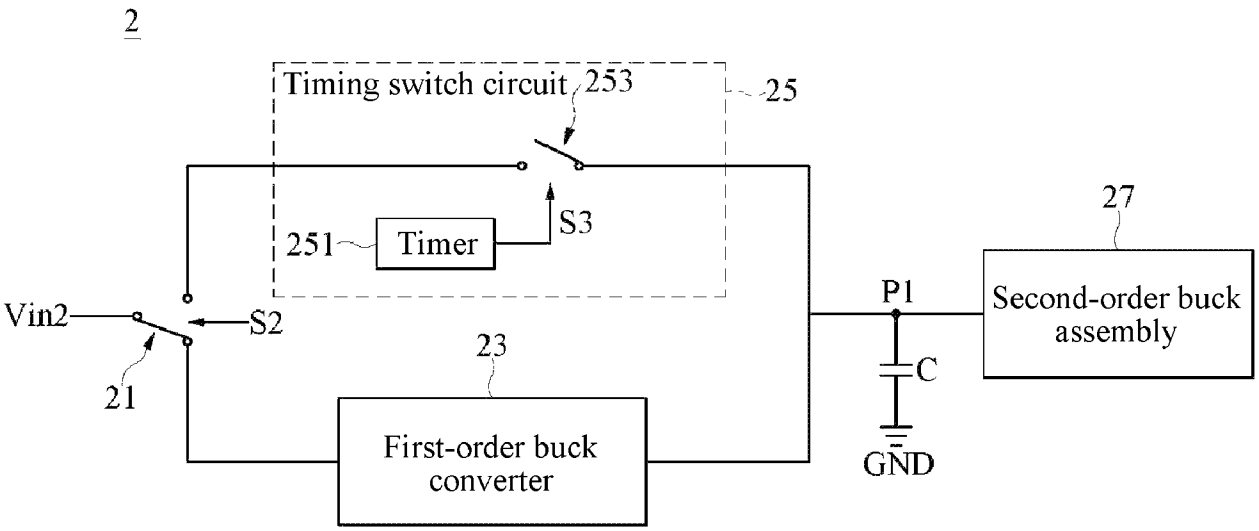
FIG. 2 is a schematic diagram of a power supply device according to an embodiment of the application.

In addition, when the input voltage is relatively high, for example, 48 volts (V), the application provides another implementation of the power supply device. Referring to FIG. 2, FIG. 2 is a schematic diagram of a power supply device according to an embodiment of the application. As shown in FIG. 2, the power supply device 2 includes a first-order buck converter 23, a second-order buck assembly 27, a timing switch circuit 25, and a second switch 21.

It should be noted that the second-order buck assembly 27 may be the power supply circuit 1 of FIG. 1, and therefore details are not described herein again. A first terminal of the timing switch circuit 25 and an output terminal of the first-order buck converter 23 are jointly coupled to an input terminal of the second-order buck assembly 27 through a node P1. However, the input terminal of the second-order buck assembly 27 is the first terminal of the input capacitor Cin in FIG. 1 and is coupled to the drain of the first N-type MOSFET Q1. One terminal of the second switch 21 is coupled to an input terminal of the power supply device 2, and the other terminal is switchably coupled to an input terminal of the first-order buck converter 23 or a second terminal of the timing switch circuit 25, so that the input terminal of the power supply device 2 is switched to be coupled to the input terminal of the first-order buck converter 23 or the second terminal of the timing switch circuit 25, and the input terminal of the power supply device 2 may receive a second input voltage Vin2 such as 48 volts higher than the first input voltage Vin1.

In this embodiment, the timing switch circuit 25 may include a timer 251 and a third switch 253. The timer 251 is configured to provide a third switch signal S3. One terminal of the third switch 253 is coupled to the first terminal of the timing switch circuit 25, and the other terminal is switchably coupled to the second terminal of the timing switch circuit 25, so that the first terminal and the second terminal of the timing switch circuit 25 are switched to be connected or disconnected. In addition, the power supply device 2 may further include a charging capacitor C. A first terminal of the charging capacitor C is coupled to the node P1, and a second terminal of the charging capacitor C is coupled to the ground terminal GND.

When an output of the power supply device 2 is not a light load, the second switch 21 is controlled by the second switch signal S2, so that the input terminal of the power supply device 2 is switched to be coupled to the input terminal of the first-order buck converter 23 through the second switch 21. Similarly, when the output of the power supply device 2 is not the light load, the first switch 17 in FIG. 1 is controlled by the first switch signal S1, so that the gate of the first N-type MOSFET Q1 is switched to be coupled to the control circuit 15, and the control circuit 15 is configured to control the first N-type MOSFET Q1 and the second N-type MOSFET Q2 to be turned on or turned off according to a feedback voltage corresponding to an output voltage Vout, so that the first N-type MOSFET Q1 and the second N-type MOSFET Q2 are respectively used as a high-side MOSFET and a low-side MOSFET in a second-order buck converter. In other words, when the output of the power supply device 2 is not the light load, the power supply device 2 can establish a circuit line of the second-order buck converter through the second switch 21, the first-order buck converter 23, the charging capacitor C, and the second-order buck assembly 27, to provide a function of a second-order buck converter.

It should be noted that the application does not limit a specific implementation of the first-order buck converter 23, and the second switch signal S2 in this embodiment may also be provided by, for example, the same embedded controller in the electronic device that provides the first switch signal S1. However, the application does not limit a specific implementation of the second switch signal S2 provided by the electronic device either. In addition, when the output of the power supply device 2 is the light load, the second switch 21 is controlled by the second switch signal S2, so that the input terminal of the power supply device 2 is switched to be coupled to the second terminal of the timing switch circuit 25 through the second switch 21. Similarly, when the output of the power supply device 2 is the light load, the first switch 17 is controlled by the first switch signal S1, so that the gate of the first N-type MOSFET Q1 is switched to be coupled to the output terminal of the operational amplifier 13, and the control circuit 15 is configured to provide the feedback voltage to the inverting input terminal of the operational amplifier 13, so that the first N-type MOSFET Q1 is used as a power transistor in a low-dropout regulator. Therefore, when the output of the power supply device 2 is the light load, the power supply device 2 may switch, through the second switch 21, to charge the charging capacitor C through the timing switch circuit 25, to supply power to the second-order buck assembly 27 that provides a function of the low-dropout regulator, thereby resolving the problem of relatively great power consumption caused by the first-order buck converter 23 when the output of the power supply device 2 is the light load. In other words, when the output of the power supply device 2 is the light load, the third switch 253 is controlled by the third switch signal S3 provided by the timer 251, so that the first terminal and the second terminal of the timing switch circuit 25 are switched to be connected or disconnected to charge the charging capacitor C.

For example, when a voltage required by the second-order buck assembly 27 at this point is ⅕ of a voltage of the charging capacitor C, the power supply device 2 controls, by using the timer 251 and the third switch 253, a duration during which the first terminal and the second terminal of the timing switch circuit 25 are connected, so that the charging capacitor C is charged only to ⅕ of its voltage. In other words, the power supply device 2 may control a capacity of the second input voltage Vin2 for charging the charging capacitor C by using the timer 251 and the third switch 253, so that the second-order buck assembly 27 providing the function of the low-dropout regulator can supply power to the electronic device with best efficiency. Similarly, the application does not limit a specific implementation of the timer 251, and the third switch signal S3 in this embodiment may also be similarly provided by, for example, the embedded controller in the electronic device. However, the application does not limit a specific implementation of the third switch signal S3 provided by the electronic device either.

Based on the above, the embodiments of the application provide a power supply circuit and a power supply device. The power supply circuit may switch the high-side MOSFET in the buck converter to serve as the power transistor in the low-dropout regulator by using the operational amplifier, the control circuit, and the first switch. Therefore, according to the application, not only the circuit lines of the buck converter and the low-dropout regulator can be integrated, but also costs can be effectively reduced. In addition, when the input voltage is relatively high and the output of the power supply device is the light load, the power supply device may switch, through the second switch, to charge the charging capacitor through the timing switch circuit, to supply power to the second-order buck assembly that provides a function of the low-dropout regulator, thereby resolving relatively great power consumption caused by the first-order buck converter when the output of the power supply device is the light load. Moreover, the power supply device controls a capacity of the input voltage for charging the charging capacitor by using the timer and the third switch, so that the second-order buck assembly providing the function of the low-dropout regulator can supply power to the electronic device with best efficiency.

Since the content provided above is merely preferred feasible embodiments of the application and does not hereby limit claims of the application, all equivalent technical changes made by using the specification and the drawings of the application are included in the claims of the application.

What is claimed is:

1. A power supply device, comprising:

a first-order buck converter;

a second-order buck assembly comprising:

a first N-type metal-oxide-semiconductor field-effect transistor (MOSFET), wherein a drain of the first N-type MOSFET receives a first input voltage;

a filter coupled to a source of the first N-type MOSFET and configured to output an output voltage;

an operational amplifier, wherein a non-inverting input terminal of the operational amplifier is coupled to a ground terminal via a first capacitor;

a control circuit coupled to an inverting input terminal of the operational amplifier; and a first switch, wherein one terminal of the first switch is coupled to a gate of the first N-type MOSFET, and the other terminal of the first switch is switchably coupled to the control circuit or an output terminal of the operational amplifier, so that the gate of the first N-type MOSFET is switched to be coupled to the control circuit or the output terminal of the operational amplifier;

a timing switch circuit, wherein a first terminal of the timing switch circuit and an output terminal of the first-order buck converter are jointly coupled to an input terminal of the second-order buck assembly via a node; and a second switch, wherein one terminal of the second switch is coupled to an input terminal of the power supply device, and the other terminal of the second switch is switchably coupled to an input terminal of the first-order buck converter or a second terminal of the timing switch circuit, so that the input terminal of the power supply device is switched to be coupled to the input terminal of the first-order buck converter or the second terminal of the timing switch circuit, and the input terminal of the power supply device receives a second input voltage higher than the first input voltage.

2. The power supply device according to claim 1, wherein when an output of the power supply device is not a light load, the second switch is controlled by a second switch signal, so that the input terminal of the power supply device is switched to be coupled to the input terminal of the first-order buck converter, the first switch is controlled by a first switch signal, so that the gate of the first N-type MOSFET is switched to be coupled to the control circuit, and the control circuit is configured to control the first N-type MOSFET to be turned on or turned off according to a feedback voltage corresponding to the output voltage, so that the first N-type MOSFET is used as a high-side MOSFET in a second-order buck converter.

3. The power supply device according to claim 2, wherein when the output of the power supply device is the light load, the second switch is controlled by the second switch signal, so that the input terminal of the power supply device is switched to be coupled to the second terminal of the timing switch circuit, the first switch is controlled by the first switch signal, so that the gate of the first N-type MOSFET is switched to be coupled to the output terminal of the operational amplifier, and the control circuit is configured to provide the feedback voltage to the inverting input terminal of the operational amplifier, so that the first N-type MOSFET is used as a power transistor in a low-dropout regulator.

4. The power supply device according to claim 3, wherein the timing switch circuit comprises:

a timer configured to provide a third switch signal; and a third switch, wherein one terminal of the third switch is coupled to the first terminal of the timing switch circuit, and the other terminal of the third switch is switchably coupled to the second terminal of the timing switch circuit, so that the first terminal and the second terminal of the timing switch circuit are switched to be connected or disconnected.

5. The power supply device according to claim 4, further comprising a charging capacitor, wherein a first terminal of the charging capacitor is coupled to the node, and a second terminal of the charging capacitor is coupled to the ground terminal, when the output of the power supply device is the light load, the third switch is controlled by the third switch signal, so that the first terminal and the second terminal of the timing switch circuit are switched to be connected or disconnected to charge the charging capacitor.

* * * * *